US010550863B1

(12) United States Patent
Marquardt

(10) Patent No.: US 10,550,863 B1
(45) Date of Patent: Feb. 4, 2020

(54) DIRECT LINK CIRCUIT

(71) Applicant: Steven H. Marquardt, Rhinelander, WI (US)

(72) Inventor: Steven H. Marquardt, Rhinelander, WI (US)

( * ) Notice: Subject to any disclaimer, the term of this patent is extended or adjusted under 35 U.S.C. 154(b) by 256 days.

(21) Appl. No.: 15/731,294

(22) Filed: May 19, 2017

Related U.S. Application Data

(60) Provisional application No. 62/392,028, filed on May 19, 2016.

(51) Int. Cl.
*F15B 13/08* (2006.01)
*F15B 13/02* (2006.01)

(52) U.S. Cl.
CPC ..... *F15B 13/0889* (2013.01); *F15B 13/021* (2013.01); *F15B 13/023* (2013.01); *F15B 13/025* (2013.01); *F15B 13/026* (2013.01); *F15B 13/085* (2013.01); *F15B 13/086* (2013.01); *F15B 13/0825* (2013.01); *F15B 13/0832* (2013.01); *F15B 13/0853* (2013.01); *F15B 13/0857* (2013.01)

(58) Field of Classification Search
CPC ..... F15B 1/024; F15B 11/024; F15B 2011/0243; F15B 13/021
USPC ..... 91/436, 437, 438
See application file for complete search history.

(56) References Cited

U.S. PATENT DOCUMENTS 2,001,620 A 8/1934 Levy
2,147,536 A 11/1937 Levy
2,385,351 A * 9/1945 Davidsen ..... B63H 25/28 244/223
2,813,970 A 11/1957 Martinson
2,856,222 A 10/1958 Gossett
3,104,125 A 9/1963 Garlinghouse
3,436,913 A 4/1969 Muller
3,476,016 A 11/1969 Dixon
3,570,244 A 3/1971 Strobel
3,608,431 A * 9/1971 Pease, III ..... F15B 11/064 91/1
3,791,690 A 2/1974 Garlinghouse
3,956,891 A 5/1976 Karazija
4,161,135 A 7/1979 Garlinghouse
4,211,078 A 8/1980 Bass
4,226,167 A 10/1980 Lew
4,397,221 A 8/1983 Friesen
4,633,665 A 1/1987 Buter
4,635,532 A 1/1987 Tanino
4,840,111 A 6/1989 Garnjost
4,969,562 A 11/1990 Yoshimi
5,007,544 A 4/1991 Saotome
5,050,380 A 9/1991 Johnsson
5,065,664 A 11/1991 Ohta
5,074,192 A 12/1991 Gheorghita
5,214,997 A 6/1993 Lebret
(Continued)

*Primary Examiner* — F Daniel Lopez
*Assistant Examiner* — Matthew Wiblin
(74) *Attorney, Agent, or Firm* — Andrus Intellectual Property Law, LLP

(57) ABSTRACT

An improved method and circuitry for fluid power applications that provides energy savings through the recycling of normally exhausted pressure by direct transfer and accumulation of exhaust pressure for additional use, including from one end of the actuator to the opposite end or within the actuator itself and for use by other devices in separate systems.

5 Claims, 7 Drawing Sheets

(56) References Cited

U.S. PATENT DOCUMENTS 5,237,916 A 8/1993 Malashenko
5,310,315 A * 5/1994 Lafortune ..... B64C 27/72 416/114
5,370,038 A 12/1994 Poppe
5,415,076 A 5/1995 Krone
5,417,064 A 5/1995 Galuszka
5,452,643 A 9/1995 Smith
5,568,759 A 10/1996 Aardema
5,570,286 A * 10/1996 Margolis ..... B60G 13/14 180/165
5,609,088 A 3/1997 Park
5,611,259 A 3/1997 Nagata
5,749,390 A 5/1998 Ermacora
5,960,695 A 10/1999 Aardema
6,095,028 A 8/2000 Lamas
6,170,383 B1 1/2001 Mauritz
6,267,548 B1 7/2001 Lech
6,327,956 B1 * 12/2001 Rink ..... F15B 11/024 91/28
6,354,790 B1 3/2002 Cummings
6,418,715 B1 7/2002 Huber
6,467,264 B1 10/2002 Stephenson
6,516,766 B2 2/2003 Porter
6,658,842 B2 12/2003 Yamasaki
6,691,604 B1 2/2004 Hajek
6,871,574 B2 3/2005 Barber
7,104,181 B2 9/2006 Bitter
7,219,592 B2 5/2007 Nielsen
7,487,707 B2 2/2009 Pfaff
8,028,613 B2 10/2011 Wrede
8,225,706 B2 7/2012 Vigholm
8,453,762 B2 6/2013 Law
8,549,983 B2 10/2013 Brahmer
8,635,940 B2 1/2014 Glodfarb
8,869,924 B2 10/2014 Kim
9,523,184 B2 12/2016 Kim
9,599,248 B2 3/2017 Goldfarb
9,605,768 B2 3/2017 Goldfarb
9,702,118 B2 * 7/2017 Gorman ..... F15B 21/14
2006/0201321 A1 9/2006 Loedige
2006/0249016 A1 11/2006 Ioka
2011/0005625 A1 1/2011 Goldfarb
2014/0158922 A1 6/2014 Golbfarb
2015/0330527 A1 11/2015 Goldfarb
2015/0354172 A1 * 12/2015 Hijikata ..... F15B 11/024 60/414
2015/0354770 A1 12/2015 Goldfarb
2016/0201813 A1 7/2016 Goldfarb

* cited by examiner

DIRECT LINK CIRCUIT

CROSS-REFERENCE TO RELATED APPLICATIONS

This application claims the benefit of provisional patent application Ser. No. 62/392,028, filed May 19, 2016.

SCIENTIFIC FIELD

The present disclosure generally relates to devices and methods for producing fluid power (pneumatic and hydraulic), and more particularly to devices and methods that increase efficiency in the movement of the air and fluid during their working cycles.

Currently, various hardware is employed in an attempt to increase efficiency with little benefit for added cost and complexity of manufacture verses the actual efficiency gain.

BACKGROUND

In the field of fluid power (pneumatic and hydraulic) experts have always looked for opportunities to increase efficiency in the movement of the air and fluid during their working cycles. Currently, various hardware is employed in an attempt to increase efficiency with little benefit for added cost and complexity of manufacture verses the actual efficiency gain.

To understand the new technology proposed in this application, a brief summary of a conventional fluid power circuit follows, as shown in FIG. 1.

In a conventional pneumatic circuit, the incoming pressure 24 is sent to an actuator (a cylinder 32) through a controlling main valve 20 that will pressurize a first side 30 of the cylinder 32 while exhausting the air from a second side 40 of the cylinder 32. This is accomplished through control of the main valve 20. In some embodiments, the main valve 20 is controlled through pilot operated valves 48*a*, 48*b* (as shown in FIGS. 2, 3, 4, and 5) in a conventional manner known in the art.

It should be noted that while reference is made to a cylinder 32 is the actuator for simplicity, the presently disclosed systems and methods are not limited to just cylinders.

Pressurizing the first side 30 and exhausting the second side 40 makes the cylinder 32 move by displacement of the piston assembly 26 and rod 28 positioned therein. This movement can then be harnessed to produce the desired work.

To return the cylinder 32 to its original starting position for another cycle, the main valve 20 changes to send incoming pressure 24 to the second side 40 while allowing the first side 30 to "vent" exhaust through the main valve 20 via vents 22, 22'. Instead of exhausting through the main valve 20 body, exhaust air may also be vented directly at the cylinder 32 through "quick exhaust" shuttle valves (not shown).

In Hydraulic power configurations known in the art generally operate in the same manner previously described. However, in a hydraulic circuit, the fluid is not vented to atmosphere, but is returned to an unpressurized reservoir (not shown) by fluid lines to be pressurized again. In the present disclosure, reference is generically be made to the the fluid (whether air or liquid) being exhausted out into a reservoir even where it is exhausted into the atmosphere.

SUMMARY

The present disclosure generally relates to an improved method and circuitry for fluid power applications that provides energy savings through the recycling of normally exhausted pressure by direct transfer and accumulation of exhaust pressure for additional use, including from one end of the actuator to the opposite end or within the actuator itself and for use by other devices in separate systems.

DRAWING DESCRIPTIONS

SPECIFICATION

This written description uses examples to disclose embodiments of the present application, including the best mode, and also to enable any person skilled in the art to practice or make and use the same. The patentable scope of the invention is defined by the claims and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The present applicant has recognized that with conventional systems and methods known in the art, significant operating time is also lost waiting for the air or fluid to fill and empty from both sides of a conventional circuit. In either case, the pressurized air or fluid is "dumped" to exhaust, without doing further work, every time the stroke changes direction. There is significant cost for the pressurization and forcing of the fluid medium through the circuit. Therefore, this conventional practice of dumping at every stroke results in expensive energy needing to be expended every time the cylinder cycles.

To allow a smaller pump size, some systems in the art have incorporated regenerative circuits are sometimes used to increase the speed of the extend cycle of a cylinder. Specifically, these systems allow exhaust from the rod end to "re-combine" with incoming pressure at the cap end. These regenerative circuits are strictly limited to extending the cylinder and the resulting pressure is significantly reduced in force.

In addition, the present applicant has identified that a regenerative cylinder must also be specially sized to allow all of the exhaust from the rod end to be accepted on the opposite side, and that additional, special valves and controls must be used. This is why regenerative circuits are not widely utilized for most applications, due to significant design time, special cylinders and valves that add significantly to initial cost.

No other prior art teaches, suggests, or implies any alternate systems or methods to recover the unused energy available in the pressure differential that exists between the cylinder sides at the end of every stroke.

Operational Definitions

In conventional fluid dynamics there are several fundamental functions and descriptions. For clarity they will defined in this section.

In a cylinder, it is possible for one side to not have a rod included. This is sometimes called the "cap" end. As a consequence for not having a rod, the working volume of the cap end is greater and, consequently, that side of the piston has a larger surface area for the pressure to push against. This creates greater applied force on the cap side of the cylinder.

Figure 1:
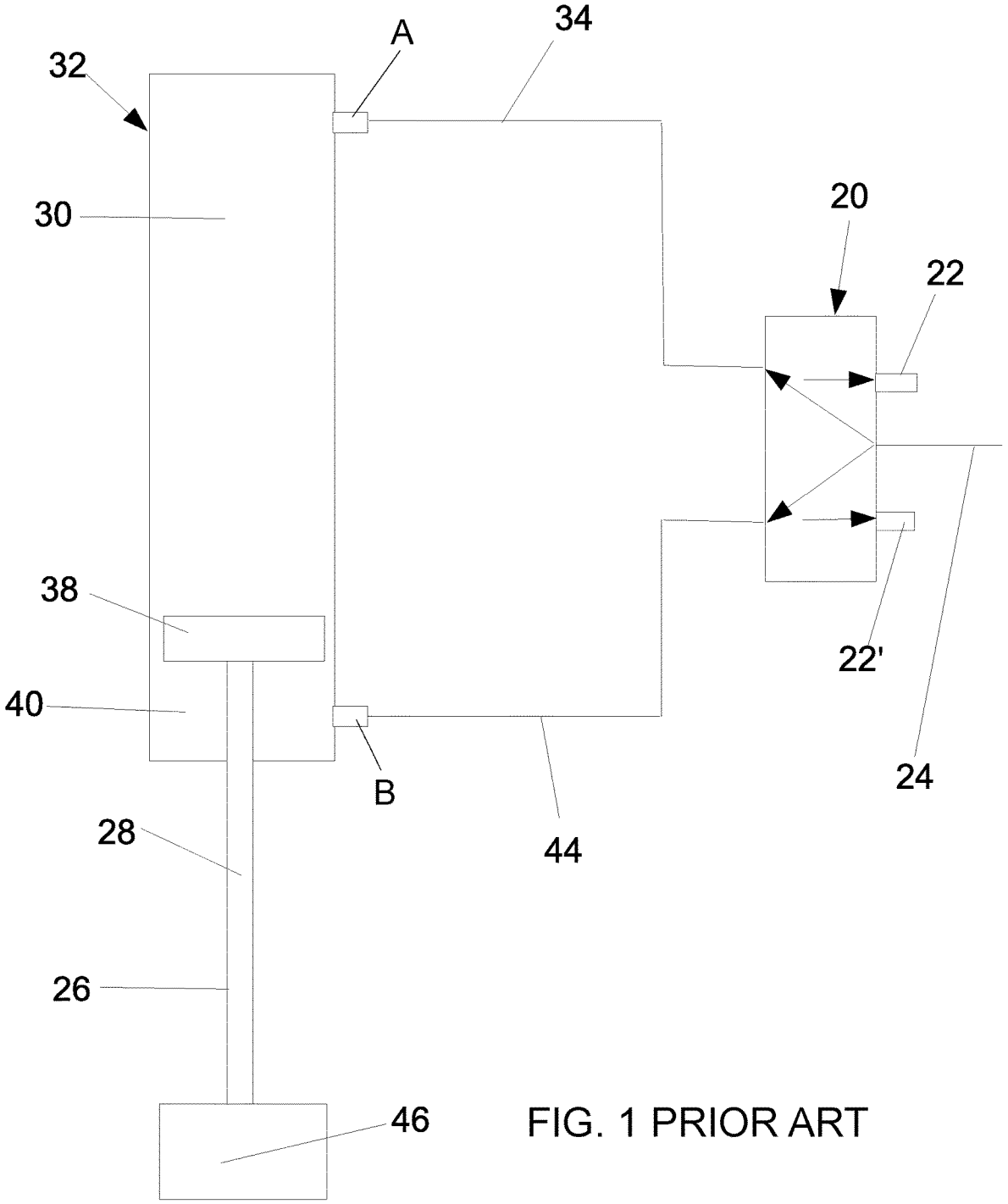
FIG. 1 PRIOR ART
FIG. 1 is a plan view of a conventional pneumatic circuit.

For clarity in this application, the cap side will also be called the "Extend" side of the cylinder 32 (side 30 in FIG. 1) as pressure applied here will cause the cylinder 32 to extend. The opposing side (i.e., the side that includes the rod 28) will also be called the "Retract" side (side 40 in FIG. 1) as the cylinder 32 retracts when pressure is applied here. Because of the reduction in surface area where the rod 28 is attached to the piston 38, this side has less applied force than the Extend 30 side at the same pressure.

It is also beneficial to define both a "Primary" side and a "Secondary" side of the circuit. The Primary side is the side of the cylinder that is receiving the incoming pressure 24 from the main valve 20 to move the piston assembly 26. In contrast, the Secondary side is the side that is exhausting pressure to allow movement of the piston assembly 26. Therefore, the Primary and Secondary sides may be located at either side Extend 30 or Retract 40 of the cylinder 32, depending on cylinder cycle position when main valve 20 is shifted.

The systems and methods of the present disclosure recycle a significant portion (over 50 percent) of this previously wasted energy during every work cycle as discussed further below.

The Direct Link Circuit

A pressure differential always exists between the two sides of a cylinder at the end of each stroke, in both directions of travel. Therefore, the present applicant has identified that there is an opportunity to recycle the existing pressure prior to it being exhausted or returned to a reservoir.

The systems and methods presently disclosed, sometimes referred to as the Direct Link Circuit (DLC), provide for the recycling of the existing pressure differential at the end of each stroke in both directions of travel. In other words, generally for one-half cycle. The DLC provides this recycling by establishing a new, controllable circuit between the two opposing ends of a cylinder at the ends of each stroke.

In one embodiment, the DLC provides a way to recycle existing pressure by creating a new pathway for pressure to follow directly from the high pressure side to the low pressure side to save valuable energy that would be exhausted in a "conventional circuit" and need to be created again.

Figure 2:
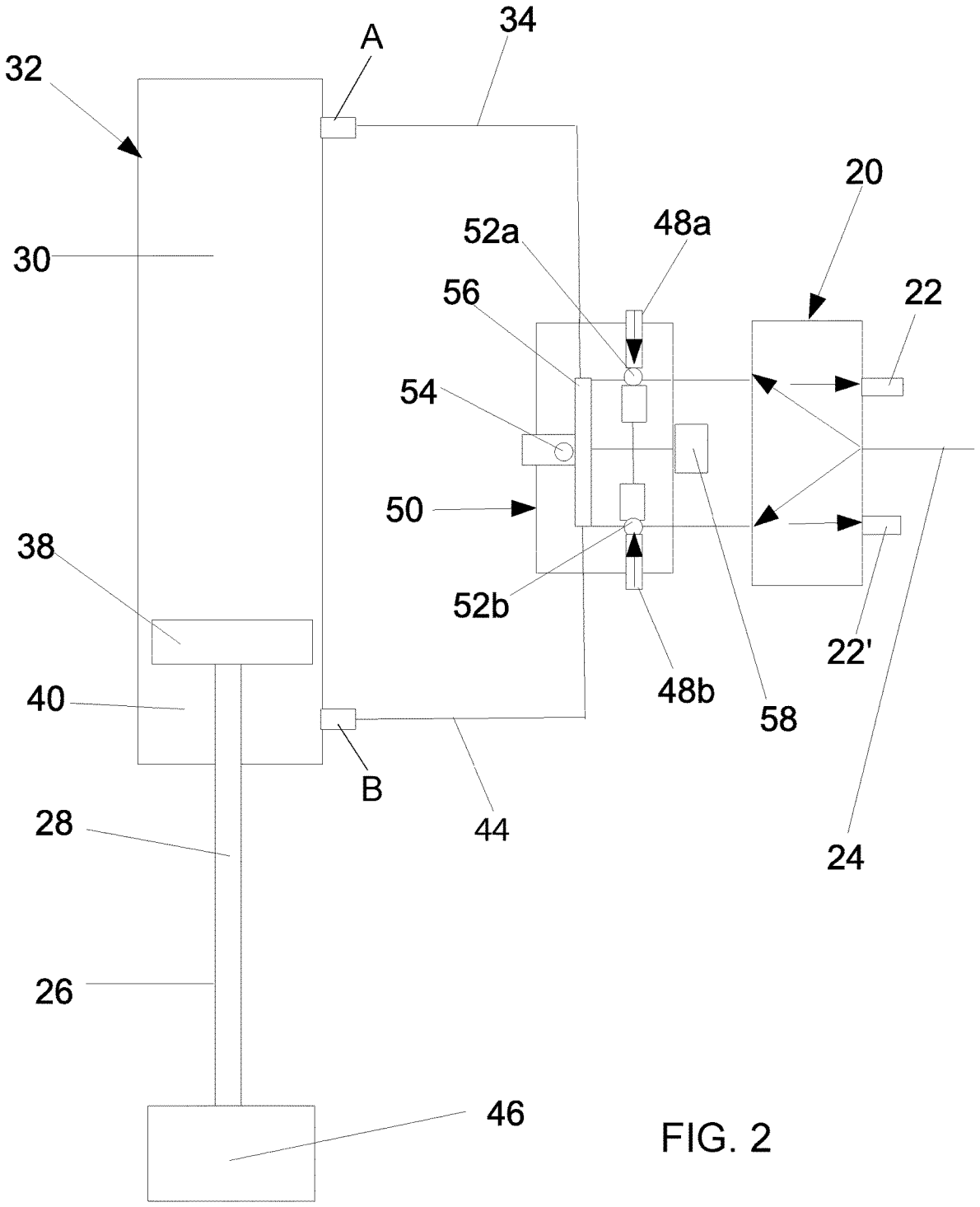
FIG. 2 is a plan view of a conventional circuit with the new Energy Saving Valve (ESV) installed.

As seen in FIG. 2, a new valve, called the Energy Saving Valve 50 (ESV), is inserted between the two "conventional" circuit lines 34, 44 required for system operation. The ESV 50 is located between the main valve 20 and cylinder 32 and creates a controllable, new Direct Link passage 56 between the opposing ends A, B of the cylinder 32. The ESV 50 provides a means to stop the flow to and from the main valve 20, while at the same time creating a new Direct Link passage 56 that directly connects the first and second sides A, B of the cylinder 32. Specifically, this is accomplished by closing the two blocking valves 52*a*, 52*b*, while at the same time opening the Link valve 54 that connects the two cylinder sides A, B, (which are connected to lines 34, 44) with the new Direct Link passage 56.

Figure 3:
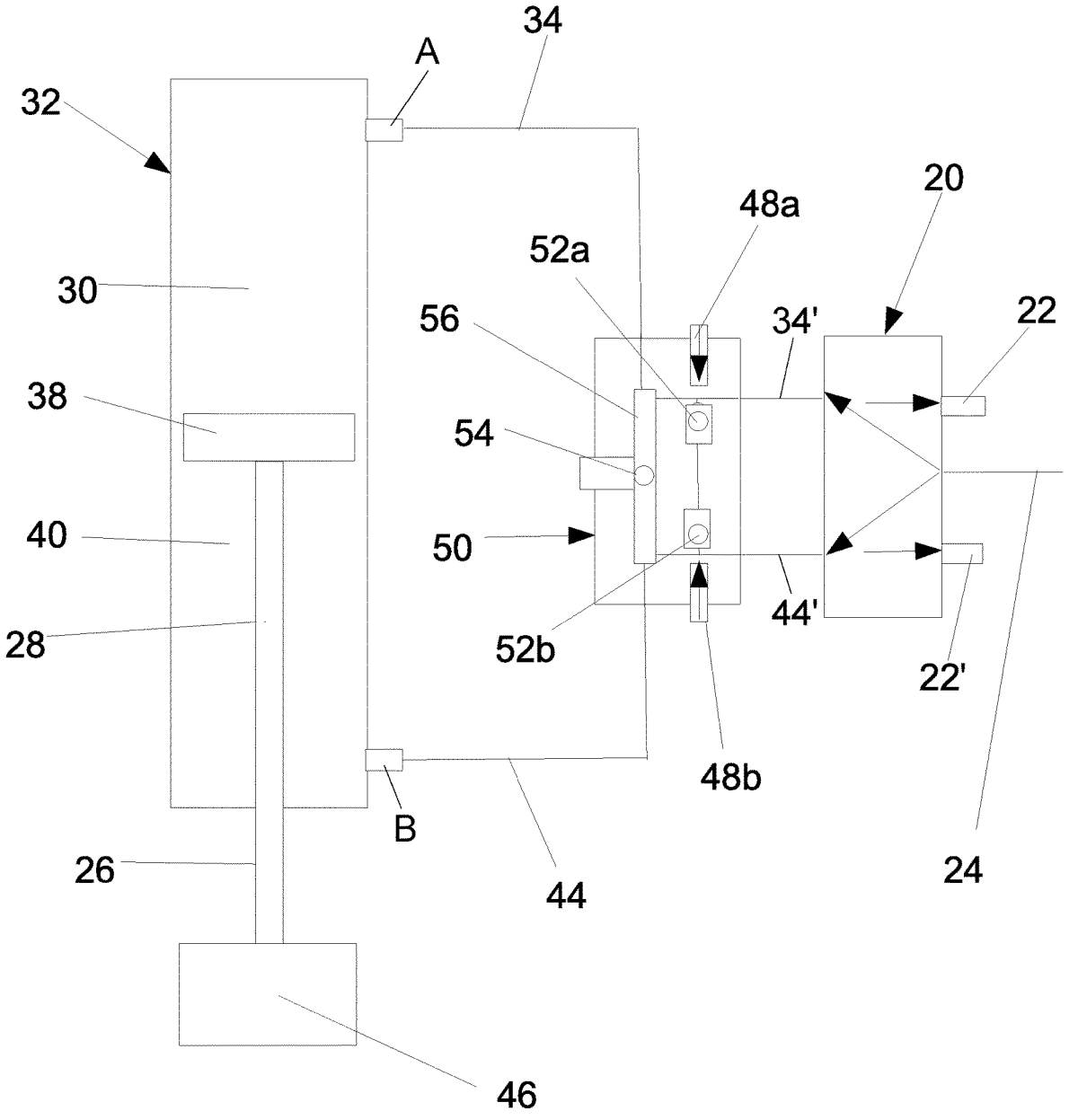
FIG. 3 is a further plan view with the ESV not activated.

In FIG. 2, the ESV 50 is shown in the "activated" position, which allows the existing pressure from side 30 to flow directly to the un-pressurized side 40 through the Direct Link passage 56, while also closing Lines 34 and 44 to the main valve 50. For example, if side 30 has a pressure of 100 PSI (pounds per square inch) and side 40 has a pressure of 0 PSI (a normal circuit situation at end of stroke), the pressurized air will flow directly to the low pressure of the cylinder (side 40) while simultaneously lowering the pressure on the originating high pressure side (side 30). When pressure balance is achieved, the pressure differential will no longer exist and the piston/load will stop moving (as shown in FIG. 3). In other words, both sides 30, 40 are now equal in force when adjusted for rod 28 differential.

At this point, the Direct Link passage 56 closes using Link valve 54 and pressure is exhausted from the Primary side, presently side 30 using pilot 48*a* and blocking valve 52*a* through the main valve 20. This sequential operation function creates a new pressure differential where the Secondary side, side 40, now has greater pressure than Primary side, side 30, which continues to move the piston assembly 26 and load 46.

During this exhausting of side 30, valve 52*b* remains closed, providing time for the piston assembly 26 and load 46 to move. This allows the stored pressure on the Secondary side, side 40, to finish the stroke with no opposing pressure on Primary side, side 30.

In certain embodiments, pilot operated valves 48*a* 48*b* or other control devices can be utilized to force the blocking valves 52*a*, 52*b* open or closed as needed for this exhausting function.

When desired, the ESV 50 will fully re-open the normal circuit using valve 52*b* to resume normal operation through main valve 20. This action allows the incoming pressure 24 to top off the cylinder 32 (on either side 30 or 40) with full pressure as needed. It should be noted that in conventional circuits, the overall circuit is usually over-designed for force, which allows even a smaller pressure force to move the actuator a significant distance.

Allowing the DLC to return a cylinder 32 in both directions using existing pressure differential that would normally be exhausted saves significant energy over conventional operation.

Re-opening of the normal circuit can be accomplished by conventional control devices, such as timers, limit switches, regulators, etc. These can also be electrically operated, such as with a solenoid. It should be noted that each of these control devices are adjustable and can be built directly into the ESV 50.

At initial activation of the ESV 50, a High pressure differential will exist between side 30 and side 40 of the cylinder 32, causing rapid movement of the cylinder piston. For better control, flow controls may be incorporated within the ESV 50 to regulate this flow in a manner known in the art (not shown). This allows the ESV 50 to be adjustable for cycle time or pressure due to factors such as existing load, operational speed desired, etc.

Figure 4:
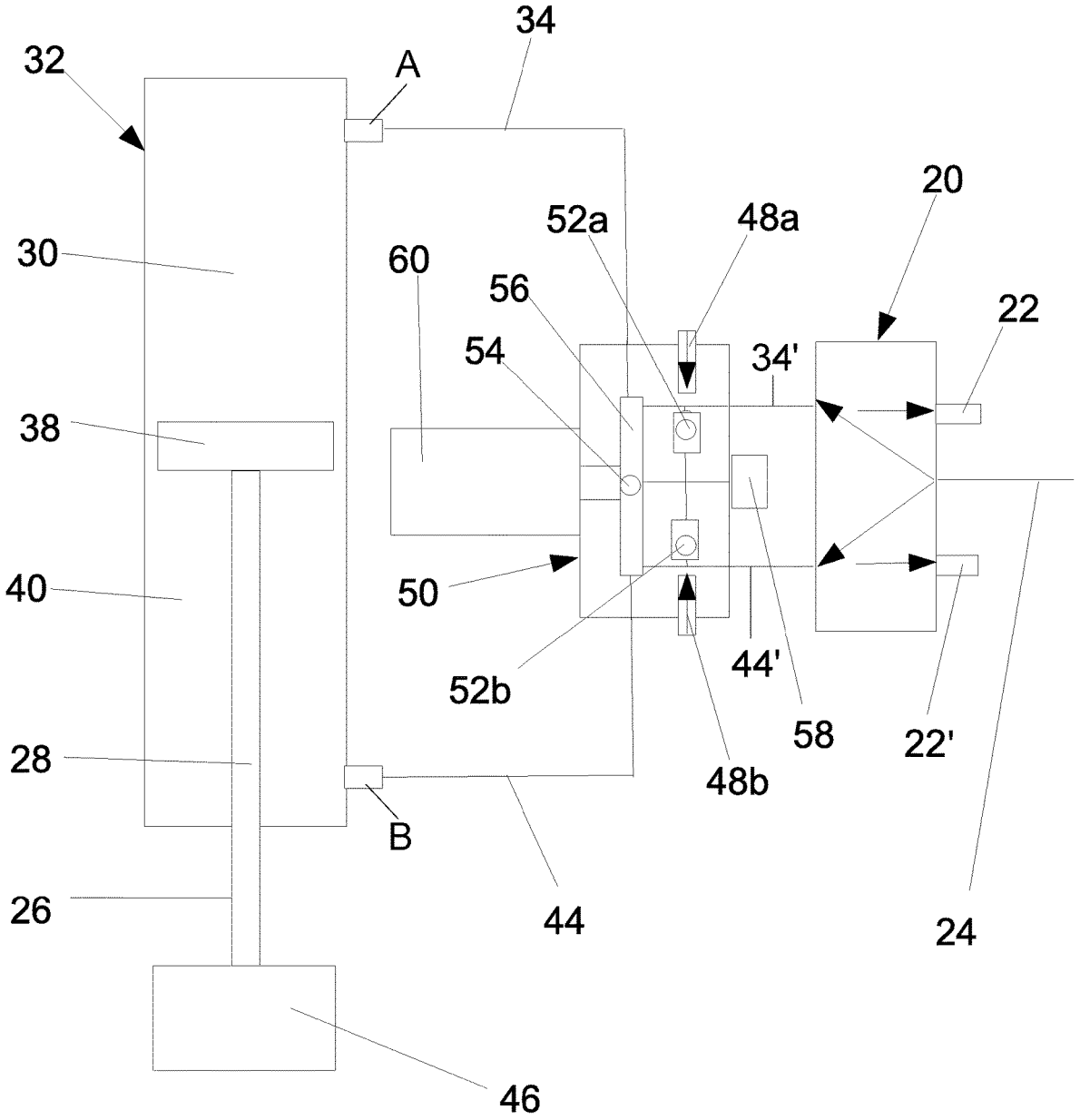
FIG. 4 is a further plan view with the ESV activated.

The ESV 50 can further incorporate conventional control devices into one unit to establish the Direct Link Circuit required for energy savings. As non-limiting examples, these include flow controls, timers, regulators, shuttle valves, etc. FIG. 4 shows one such optional timer 58. Likewise, the ESV 50 may be built directly into the main valve 20 body as one unit, thus eliminating lines 34' and 44'.

In certain embodiments, two vents (which may be pilot, timer, or otherwise operated) are provided in the ESV 50 such that when the Direct Link passage 56 closes, the Primary pressure side will vent the remaining pressure directly at the ESV 50.

Figure 5:
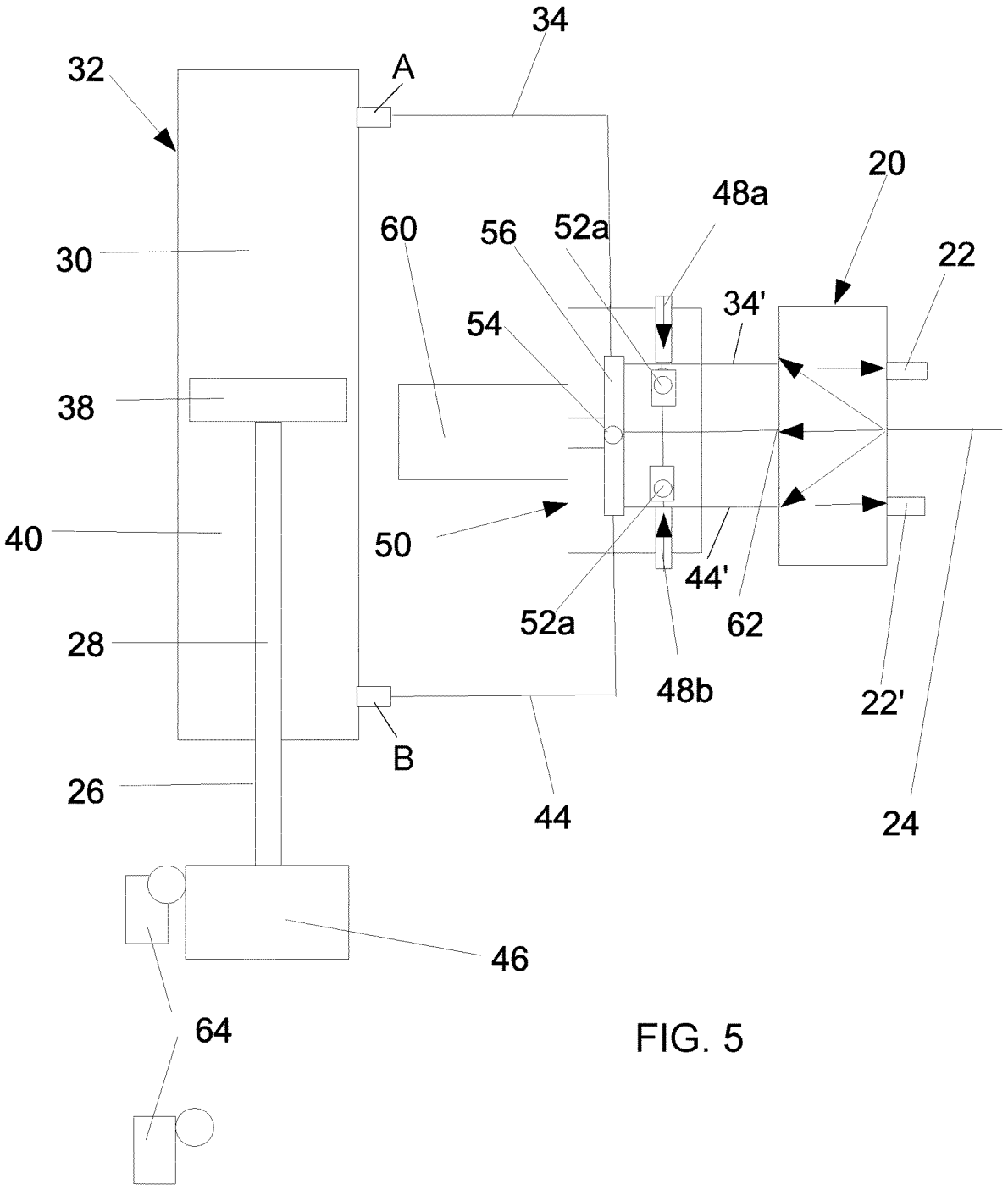
FIG. 5 is a further plan view with the ESV activated and an accumulator and limit switches added.

In other embodiments, such as those shown in FIGS. 4 and 5, the ESV 50 can further incorporate an Accumulator 60 to store additional pressure for use by the Secondary side. This provides a larger increase in the amount of pressure recycled. Specifically, the Accumulator 60 further provides a means to permit more pressure to leave the Primary side without venting it to exhaust, allowing further actuator movement. The Accumulator's 60 pressure can also serve to activate a binary or other type valve for system operation. In certain embodiments, the Accumulator 60 may also be installed at a separate location for space considerations, using conventional tubing or pipe to conduct the flow (not shown).

Another novel way of activating any DLC is to provide a main valve 20 port (shown at the center position 62) that is activated as the valve shifts, as shown in FIG. 5. Activation of the Direct Link Circuit can be from any control device such as: the limit switches 64, from one of the pressurized lines of the main circuit (34, 44) or a pilot valve based on a set pressure or lack of pressure. As per any fluid power circuit, all valves can be normally opened or closed depending on the activation available or desired. Likewise, all circuitry and controls may also be electronically activated using conventional electronic methods, including position sensors. The DLC may further be directly incorporated into various fluid power devices [such as transfer pumps and intensifiers] to provide additional energy savings (not shown).

Figure 6:
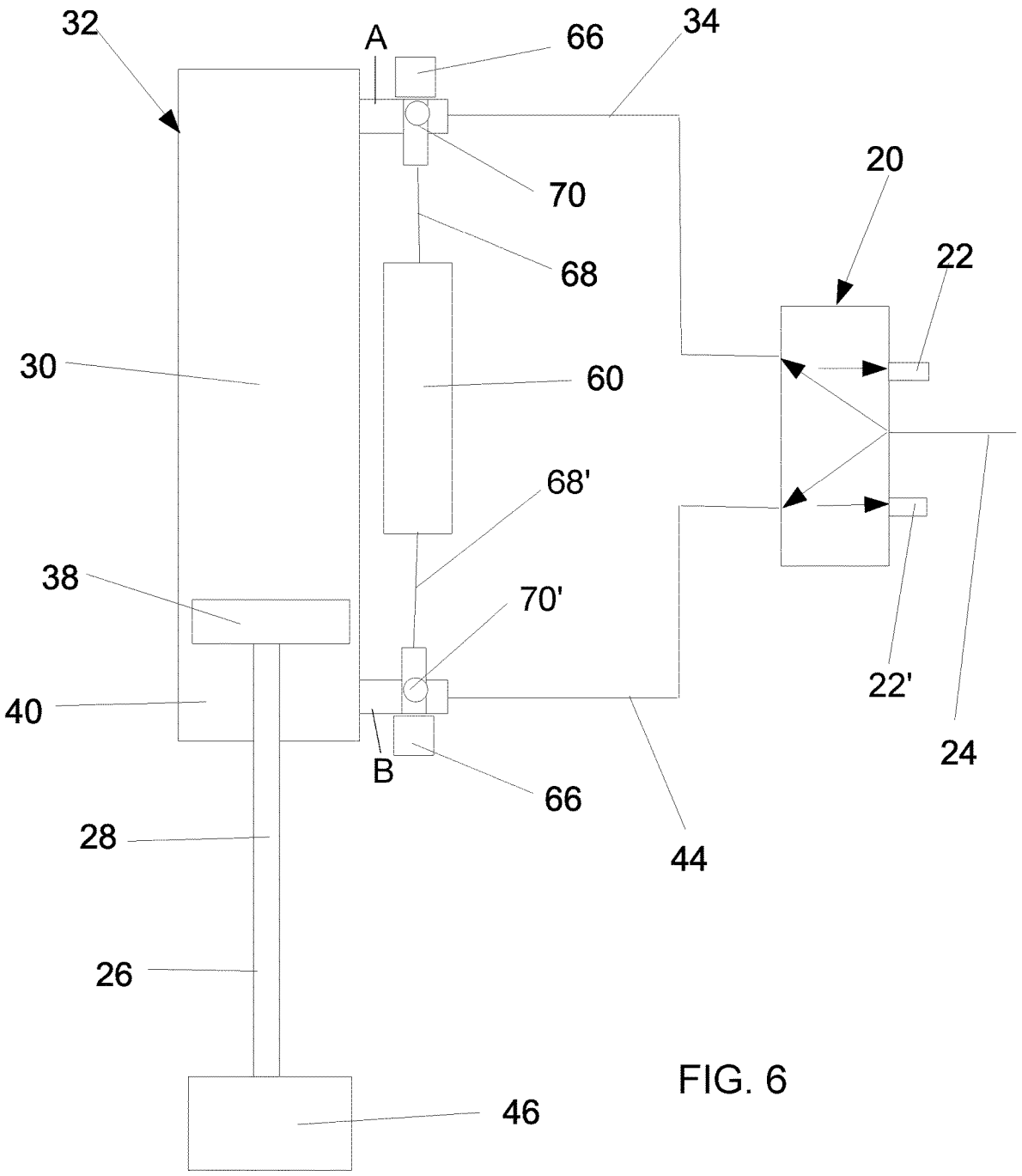
FIG. 6 is a plan view with Component Valves at each cylinder end and an added accumulator.

The new Direct Link Circuit may be provided by a singular ESV 50, as discussed above, or two, individual component valves. As seen in FIG. 6, the DLC incorporates Component Valves 70, 70' (CV's) at each end A, B of the cylinder 32. The CV's 70, 70' provide both the blocking function of the main lines (34, 44) and the connection function to the Direct Link lines 68 and 68'.

The CV's 70, 70' may further include controllable exhaust ports 66, 66' to directly vent exhaust. The CV's 70, 70' can be conventionally activated by normal control devices, or may be internally activated by pressure, vacuum or binary (sequential) means.

A separate Accumulator 60 may be installed directly on the Direct Link line 68, 68' as desired for higher energy savings in accordance with the previous discussion.

This new DLC provides a means to recover a significant portion of the energy of every stroke, in both directions of travel, during operation. The present applicant has identified that this savings is over 50% of the pressurized fluid or air. In this regard, the Direct Link Circuit, using either the ESV 50 or CV's 70, 70', provide a novel means to accomplish more work, while requiring minimal to no additional incoming pressure 24 from the main valve 20.

Figure 7:
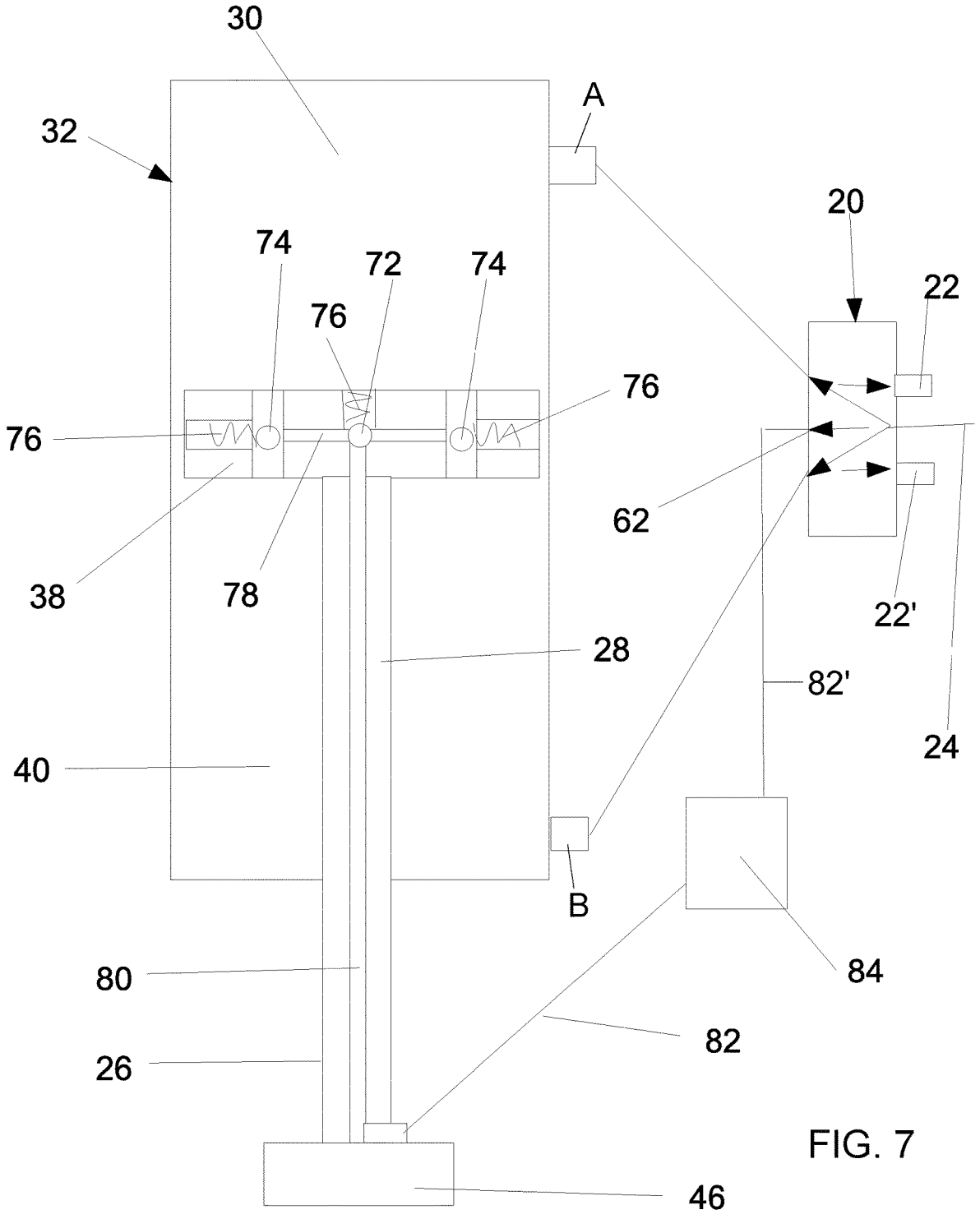
FIG. 7 is a plan view of a cylinder with an Internal Direct Link.

The Internal Direct Link in further embodiments of the present disclosure, the Direct Link Circuit is directly incorporated into the piston 38 of the cylinder 32, as shown in FIG. 7. In these embodiments, the DLC is provided by an internal Piston Link valves 74 and passage 78 located "within" the piston 38 itself. While one valve may be used in some embodiments, it may nonetheless be referred to in the plural form as piston link valves 74. FIG. 7 shows the DLC in the closed position.

The Piston Link valves 74 can be opened by the Activating Line 82, 82' connected directly to the rod 28 of the piston assembly 38. The rod 28 contains an activating passage 80 to allow the activating pressure to reach the internal Activating valve 72. This allows the Activating valve 72 to be used as a trigger for initial opening of the Piston Link valves 74 using passages 78. When the Activating valve 72 opens the secondary passage 78 to the Piston Link valves 74, they will also open, allowing the pressure differential to flow through the piston 38 itself for immediate stroke reversal. The Activating valve 72 (normally closed, spring return) is returned to the closed position by springs 76 once activating pressure is removed. It should be recognized that the springs 76 may also be one spring.

In certain embodiments, a delay timer 84 is used to remove the pressure from the Activating Line 82 to allow activating valve 72 and Piston Link valves 74 to close.

The Piston Link valves 74 (normally closed, spring return) can also be returned to the "closed" position by springs 76 when spring pressure "overrides" the pressure that is passing through piston 38. In this case, the main valve 20 center position 62 would be used to momentarily open the Activating valve 72 and Piston Link valves 74 for operation and no delay Timer 84 would be needed. Activation and timing of the Internal Direct Link can be controlled by conventional or ESV circuitry outside the cylinder 32. Likewise, an external Accumulator 60 may be used to store pressure for later use, as discussed above.

The Internal Direct Link provides a novel way to further speed up cycle time and save energy by building the Direct Link Circuit inside the cylinder 32 itself.

With any embodiments incorporating an accumulator 60, it should be known that the accumulator 60 may be connected to other actuators as desired to provide a "cascade" of usable pressure for additional work. This method allows accumulated pressure to supply other actuators in a system or be re-cycled to the inlet of the pressure generating device (such as a compressor or fluid pump) for further efficiency. In this manner, the initial energy of the first system can be utilized in many different devices and for more energy savings than any conventional system.

The present applicant has identified that the presently disclosed DLC may be provided in various modes to allow adaptation to existing systems, or for completely new installations.

In summary, the Direct Link Circuit establishes a controllable, direct link between the two sides of any actuator. Through this direct link, the existing pressure differential at the end of each stroke can be recycled into additional motion instead of being wasted. Fluid power systems presently known in the art, both pneumatic and hydraulic, currently waste this pressurized air (or fluid) to exhaust (or reservoir tank) because they lack the capabilities now provided by the DLC.

Furthermore, the presently disclosed Direct Link Circuit also provides a way to increase operational speeds and to shorten the distance traveled for the air/fluid flow, thereby increasing cycle speed.

The DLC can be implemented for a low cost and is easily installed as a new device or for retrofitting existing systems.

As described above, the Direct Link Circuits can be further equipped with accumulators 60 for additional energy savings, saving a greater amount of the pressurized fluid or air for reuse. The Internal Direct Link further provides the fastest operation of any cylinder by locating the Direct Link Circuit inside the cylinder itself. The present applicant has demonstrated that the new Direct Link Circuit directly saves energy by recycling a significant portion of the wasted energy of current system operation. By providing a controllable, Direct Link Circuit between the opposing sides of any pressure differential, un-tapped and previously wasted energy is recycled to accomplish additional work.

It should further be understood that persons skilled in the art may reconfigure, add to or "manufacture into" conventional devices the various functions required to establish the novel Direct Link Circuit proposed.

In the above description, certain terms have been used for brevity, clarity, and understanding. No unnecessary limitations are to be inferred therefrom beyond the requirement of the prior art because such terms are used for descriptive purposes and are intended to be broadly construed. The different assemblies described herein may be used alone or in combination with other devices. It is to be expected that various equivalents, alternatives and modifications are possible within the scope of any appended claims.

I claim:

1. A method for conserving energy when moving a piston assembly within a cylinder using a fluid, wherein the cylinder has a first side and a second side that is opposite the first side, wherein the piston assembly has a piston that moveably separates the first side and the second side of the cylinder, wherein the first side and the second side are each configured to receive fluid from an incoming fluid line and also configured to exhaust the fluid out, the method comprising:

fluidly connecting an energy saving valve between the first side and the second side of the cylinder, wherein the energy saving valve has a link valve, a first blocking valve, and a second blocking valve each having at least an open position and a closed position, and wherein the link valve selectively fluidly connects the first side to the second side of the cylinder;

fluidly connecting the energy saving valve to the incoming fluid line, wherein the first blocking valve selectively fluidly connects the first side of the cylinder to the incoming fluid line, and wherein the second blocking valve selectively fluidly connects the second side of the cylinder to the incoming fluid line;

configuring the energy saving valve to perform each of:

positioning the link valve in the open position to allow the fluid to flow between the first side and the second side of the cylinder;

positioning the link valve in the closed position, positioning the first blocking valve in the closed position, and positioning the second blocking valve in the open position such that the fluid flows from the incoming fluid line to the second side; and positioning the link valve in the closed position, positioning the second blocking valve in the closed position, and positioning the first blocking valve in the open position such that the fluid flows from the incoming fluid line to the first side;

whereby energy is conserved by allowing the fluid to flow between the first side and the second side when moving the piston assembly.

2. The method of claim 1, the method further comprising the step of:

a sequential control mechanism that controls a sequence of operation for the energy saving valve positioning the link valve.

3. The method according to claim 2, wherein the sequence of operation further provides:

a first operation in which the fluid remaining in the first side has a high pressure subsequently flows to the second side;

a second operation in which the fluid remaining in the first side has a low pressure and is exhausted at completion of the first operation, wherein the second operation further prevents exhausting of the fluid in the second side; and a third operation providing a delay of additional flow of the fluid to accommodate movement of the piston.

4. The method according to claim 1, whereby energy is conserved both when the fluid flows from the first side to the second side when moving the piston assembly in a first direction, and also when the fluid flows from the second side to the first side when moving the piston assembly in a second direction that is opposite the first direction.

5. The method of claim 1, wherein the cylinder is fluidly coupled to a reservoir having a pressure that is equal to atmospheric pressure and the reservoir receives the fluid exhausted out of the first side and the second side, and wherein the energy saving valve causes the fluid from the first side to flow to the second side before the fluid is exhausted out to the reservoir.

* * * * *